United States Patent [19]

Bogese, II

[11] Patent Number: 4,717,217

[45] **Date of Patent: * Jan. 5, 1988**

[54] CONNECTOR FOR MATING MODULAR PLUG WITH PRINTED CIRCUIT BOARD

[75] Inventor: Stephen B. Bogese, II, Roanoke, Va.

[73] Assignee: Virginia Patent Development Corporation, Roanoke, Va.

[ * ] Notice: The portion of the term of this patent subsequent to Jul. 3, 2001 has been disclaimed.

[21] Appl. No.: 748,717

[22] Filed: Jun. 26, 1985

Related U.S. Application Data

[63] Continuation of Ser. No. 565,478, Dec. 27, 1983, abandoned, which is a continuation of Ser. No. 215,054, Dec. 10, 1980, Pat. No. 4,457,570, which is a continuation-in-part of Ser. No. 120,846, Feb. 12, 1980, which is a continuation of Ser. No. 915,457, Jun. 14, 1978, abandoned.

[51] Int. Cl.[4] ..... H01R 9/09

[52] U.S. Cl. ..... 439/83; 439/344; 439/495

[58] Field of Search ..... 339/17 R, 17 C, 17 LC, 339/19, 91 R, 176 M, 217 R, 218 R, 218 M, 222, 278 C

[56] References Cited

U.S. PATENT DOCUMENTS

| | | | |
|---|---|---|---|
| 3,399,377 | 8/1968 | Warzecka | 339/176 MP |
| 3,696,319 | 10/1972 | Olsson | 339/17 F |
| 4,025,147 | 5/1977 | Van Arsdale | 339/176 MP |
| 4,040,699 | 8/1977 | Rasmussen | 339/91 R |
| 4,186,988 | 2/1980 | Kobler | 339/176 MP |

*Primary Examiner*—Joseph H. McGlynn

*Attorney, Agent, or Firm*—Saidman, Sterne, Kessler & Goldstein

[57] ABSTRACT

An electrical connector or modular jack for directly coupling a printed circuit board and a standard, miniature, telephone-style modular plug. The jack housing includes an opening in the front portion thereof for receiving the modular plug that features a plurality of planar, insulation-piercing contact terminals. The jack includes conductors having spring contact portions that extend angularly forwardly from the rear part of the opening to be engaged with the similarly spaced contact terminals of the modular plug. The other ends of the jack's conductors extend normally from an outer wall of the housing in an alternating, staggered fashion to fit within correspondingly spaced apertures in the printed circuit board. An alternate embodiment provides a low profile modular jack particularly adapted for use with closely-spaced printed circuit boards. The low profile embodiment features a side-mounted latching assembly.

31 Claims, 23 Drawing Figures

FIG. 1
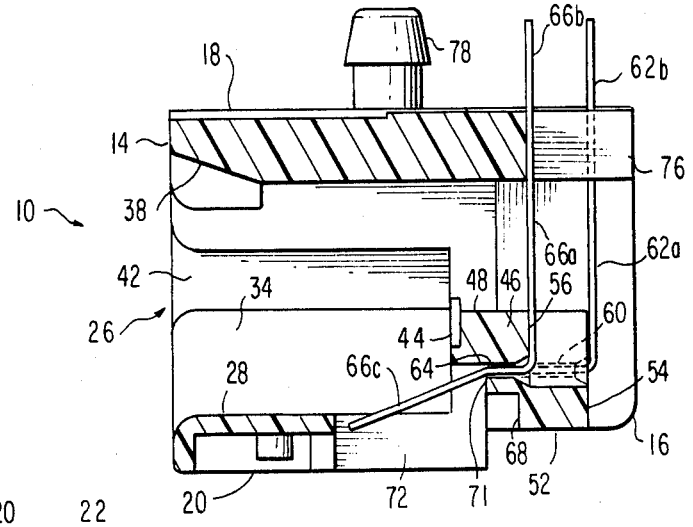
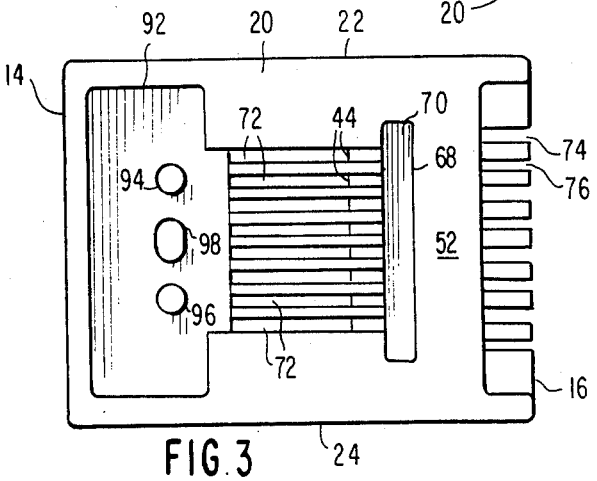
FIG. 2
10
FIG. 3
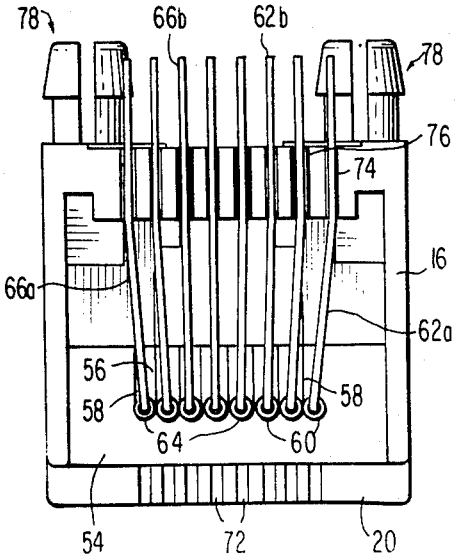
FIG. 4
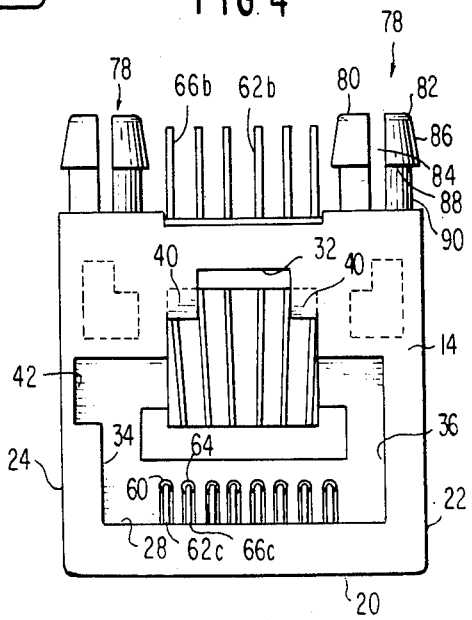

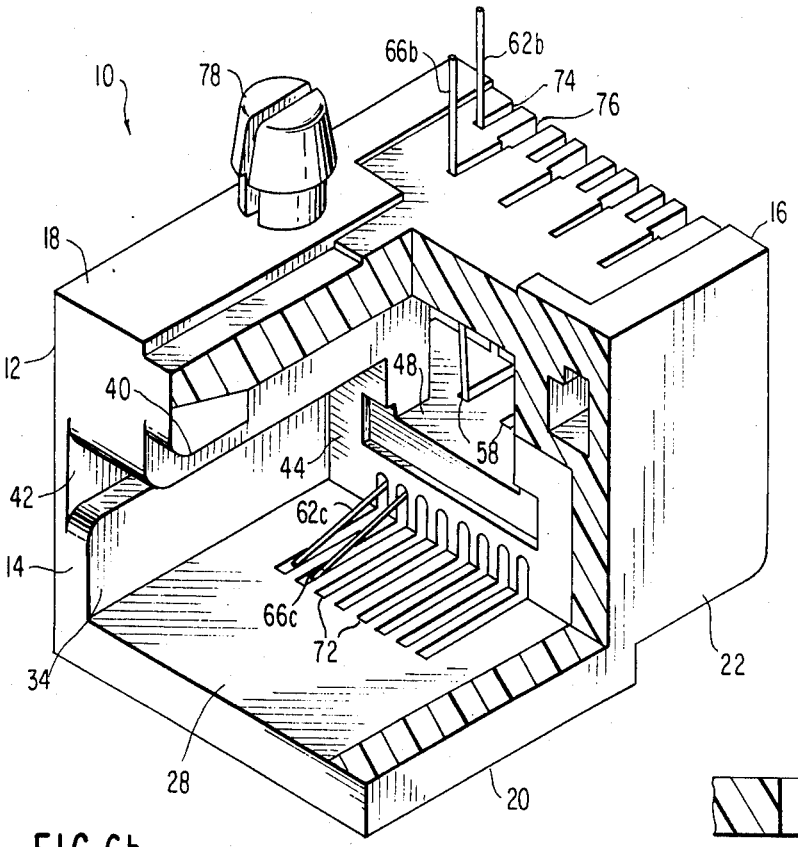
FIG. 5
FIG. 6c
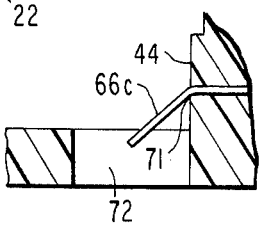
FIG. 6b
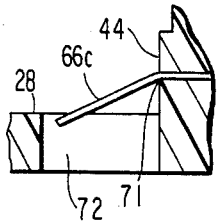
FIG. 6
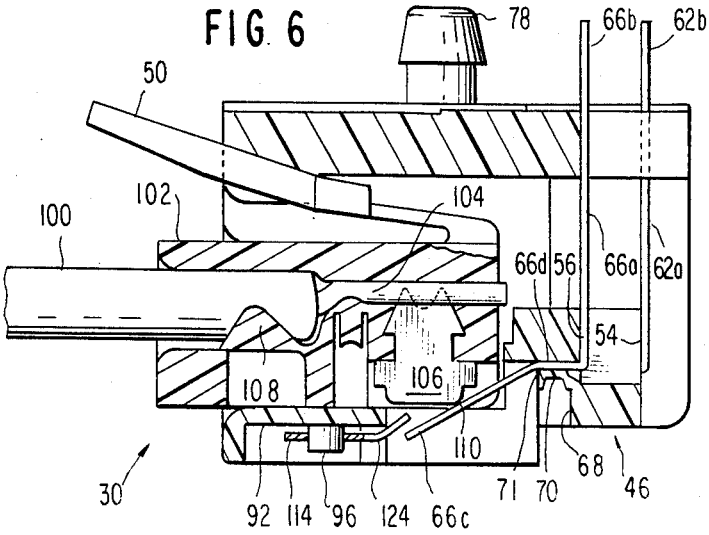
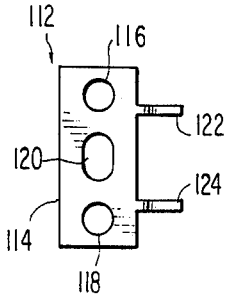
FIG. 6a

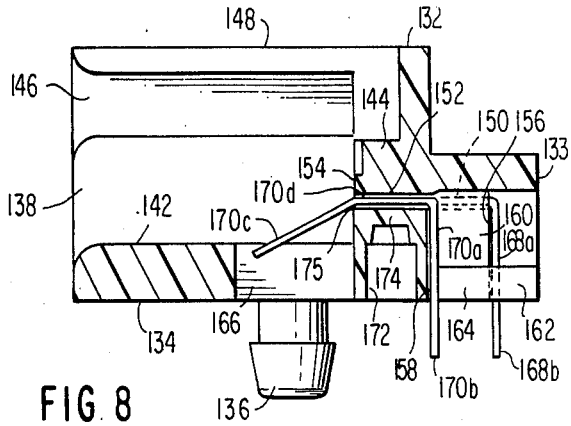
FIG. 8
FIG. 8a
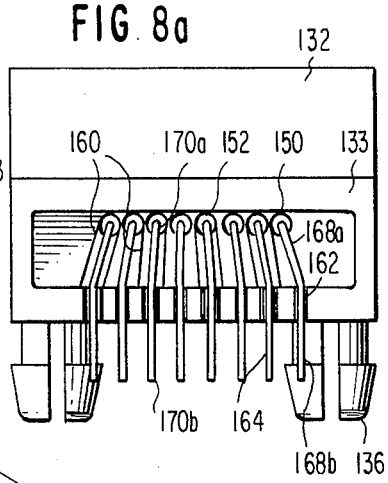
FIG. 7
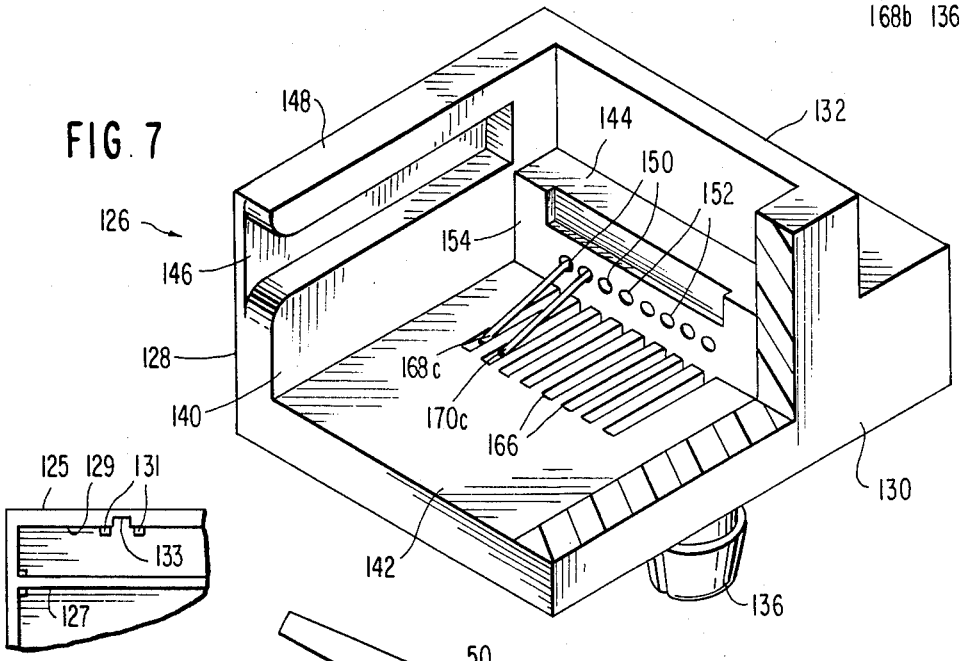
FIG. 9a
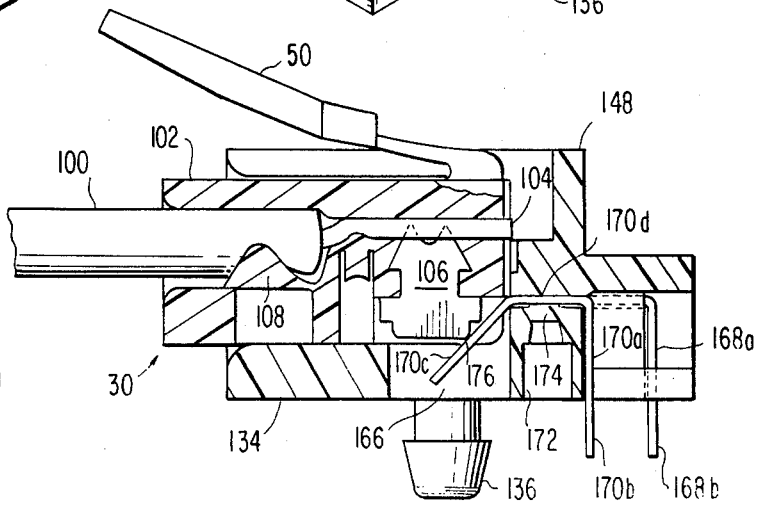
FIG. 9

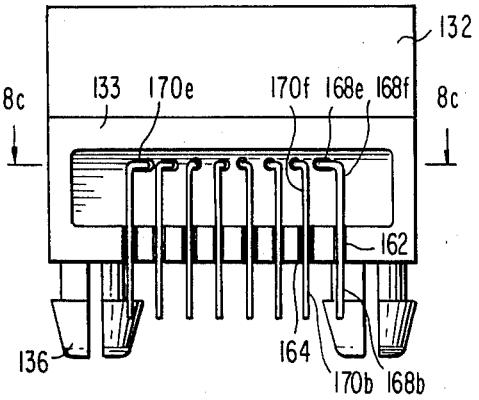
FIG. 8b
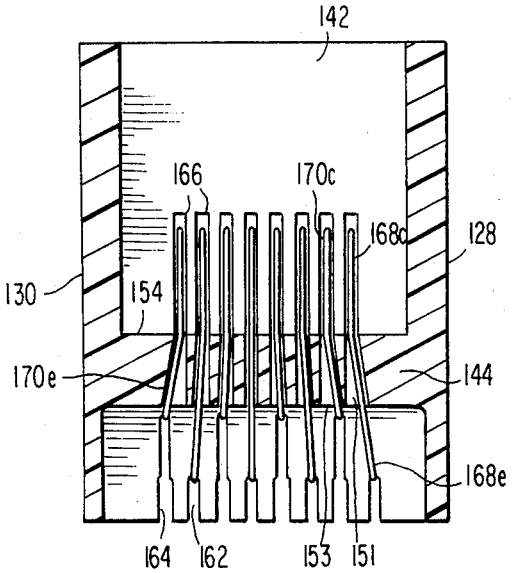
FIG. 8c
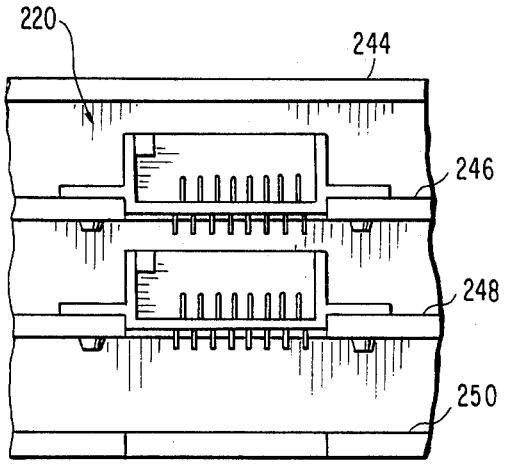
FIG. 15
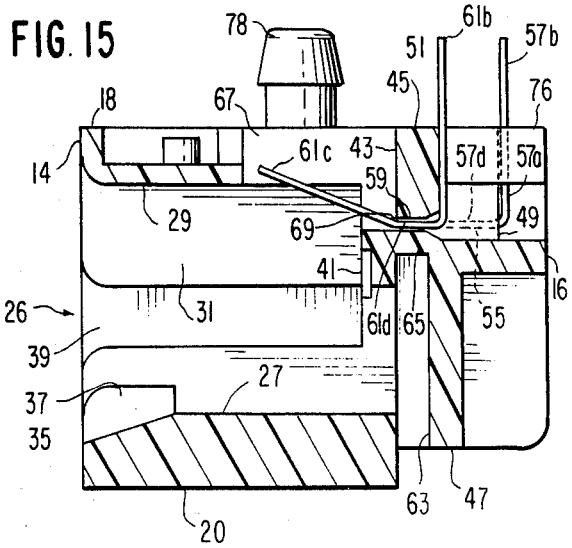
FIG. 16
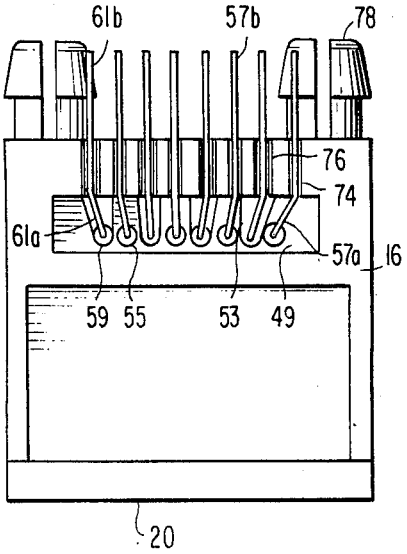

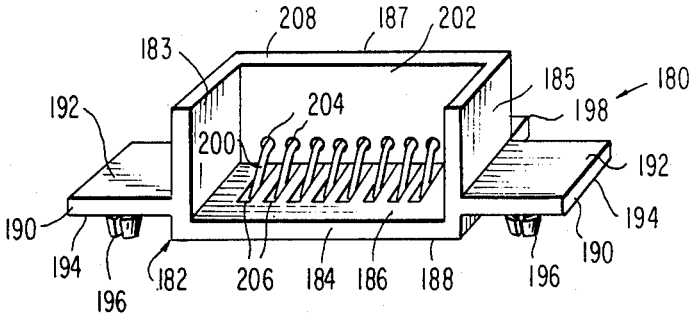
FIG. 10
FIG. 11
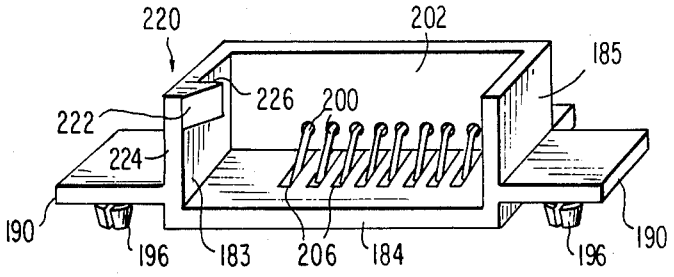
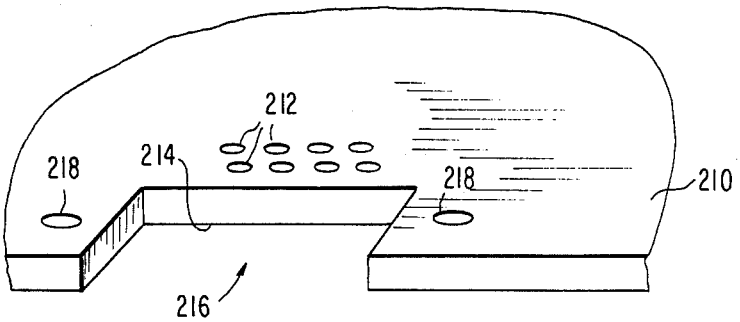
FIG. 12
FIG. 13
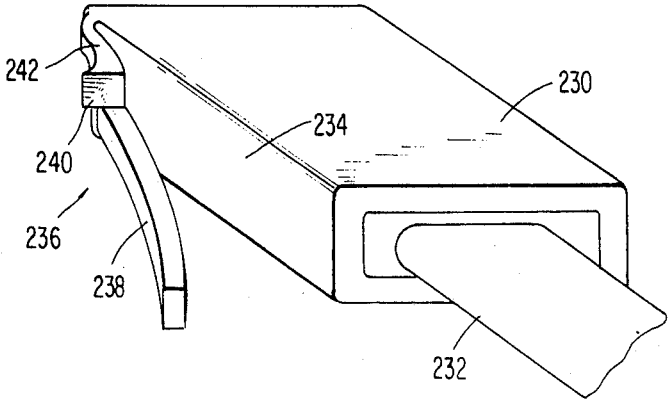

CONNECTOR FOR MATING MODULAR PLUG WITH PRINTED CIRCUIT BOARD

CROSS REFERENCE TO RELATED APPLICATIONS

This application is a continuation of application Ser. No. 565,478, filed 12/27/83, now abandoned, which is a continuation of application Ser. No. 215,054, filed Dec. 10, 1980 now U.S. Pat. No. 4,457,570, which is a continuation-in-part of my prior U.S. application Ser. No. 120,846, filed 12 Feb. 1980, which is, in turn, a continuation of U.S. application Ser. No. 915,457, filed 14 June 1978 and now abandoned.

BACKGROUND OF THE INVENTION

1. Field of the Invention

The present invention is related to electrical connectors, and more particularly is directed towards a new and improved modular jack adapted to serve as an interface between a standard modular plug and a printed circuit board.

2. Description of the Related Art

In recent years, a great deal of research and development has gone into providing miniature plugs and connectors for low voltage electronic applications. For example, in the telephone industry, increasing use is being made of modular plugs and connectors on the cords, base, handset and wall terminal block of a telephone system. Typical miniature plugs are described, for example, in U.S. Pat. Nos. 3,954,320 and 3,998,514, both in the name of Hardesty.

It is desirable that such plugs and connectors be of rugged construction, compact size and high reliability, without requiring excessive manufacturing cost. Such plugs and connectors must also be able to be reliably, rapidly and automatically terminated to cable and equipment components, respectively.

While the plugs and connectors provided in the past have been generally satisfactory, they suffer from one or more material drawbacks. For example, the miniature connector described in U.S. Pat. No. 3,850,497 is generally a rugged and compact unit. However, the complexity of the contact wire assembly utilized in the housing of the connector results in a high manufacturing cost because of the many components which must be assembled in a precision arrangement. Additionally, the interconnect portions of the contact wire assembly which protrude from the rear of the connector housing consist of flexible jumper wires which have spade terminals or solder tabs for making connections to equipment components. Such terminals or tabs must be manually anchored or set in position for making the desired electrical connections. This procedure results in high labor costs when such connectors are mounted, for example, on printed circuit boards or to their electronic or telephone components. A similar connector is described in U.S. Pat. No. 3,990,764, but suffers from the same deficiencies just described.

The aforedescribed connectors also suffer from an additional major drawback. Regulations governing the size and spacing of standardized plugs have been adopted by the Federal Communication Commission. Consequently, any connector designed to mate with such plugs must have corresponding spacing between adjacent contact wires. However, printed circuit boards (hereafter "PCBs") which are utilized extensively, for example, in digital data transmission equipment, sensing systems and the like, are presently manufactured with an industry-wide standard for conductor pad spacing that is different from the contact spacing on the above-described miniature telephone plugs and connectors. As a result, with these components, it has been necessary in the past to provide jumper wires or a special cable to connect the standard miniature telephone connector or jack with a PCB.

In my pending U.S. patent application Ser. No. 120,846, filed 12 Feb. 1980 (a continuation application of Ser. No. 915,457, filed 14 June 1978), I set forth a novel electrical connector particularly adapted to serve as a direct interface between a standard miniature telephone plug and a printed circuit board, thereby eliminating the need for labor intensive jumper wires or special cables. The connector described in my prior applications includes a plurality of conductors formed in the connector housing, one end of each of the conductors extending from the rear portion of the housing in an alternating, staggered fashion so as to mate with correspondingly spaced apertures (about which the conductor pads are formed) in a printed circuit board. The conductors extend through the body of the housing to the front portion thereof and are then bent rearwardly into a plug-receiving opening so as to form spring contact portions which are laterally spaced so as to correspond with the contact terminal spacing of the mating plug. It is essential in this design, to facilitate plug mating and attachment of the connector to the printed circuit board for subsequent wave soldering, that there exists a differential spacing between the contact portions of the conductors that extend rearwardly into the connector opening and the alternating staggered portions of the conductors which extend perpendicularly from the rear portion of the connector. More particularly, a common PCB spacing requires adjacent conductor apertures to be spaced 0.050 inch apart, while the Federal Communications Commission requires 0.040 inch spacing between the spring contact portions of corresponding adjacent conductors.

Several United States patents are set forth a miniature connector for directly interfacing a modular plug with a printed circuit board. More particularly, U.S. Pat. Nos. 4,193,654 and 4,221,458 each set forth a connector housing wherein the spring contact portions extend over an outside wall of the connector housing to be subsequently bent rearwardly into the opening to form the spring contact portions. The other ends of the conductors extend from the housing in alternating rows so as to allegedly be matable with the apertures in a printed circuit board; however, no differential spacing is provided between the spring contact portions and the PCB matable portions of the conductors.

U.S. Pat. No. 4,210,376 sets forth a connector similar in concept to the above-described patents, but which does take into account the necessary differential spacing required between the spring contact portions and the PCB-terminable portions of the conductors (See FIG. 6). However, the connector structure described in this patent still necessitates a relatively long strip of stamped conductor to be utilized since the conductors are wrapped around the outside wall of the connector from the rear to the front and are bent back into the connector opening so as to form the spring contact portions.

The length of the conductors required for such connectors involves a considerable component cost, inasmuch as such conductors must generally be plated with a precious metal to meet industry standards regarding reliability, longevity and electrical contact integrity. The precious metal may comprise, for example, gold, and it therefore may be appreciated that it would be highly desirable to provide an improved connector which could utilize conductors of considerably reduced lengths over previous designs.

The gold plated spring contact portions of presently known connectors are bent rearwardly into the plug-receiving opening of the connector housing at a fixed angle which achieves the contact pressure required with the terminals of the mating plug to maintain industry standards of conductivity, wear and reliability. If the contact pressure could somehow be increased, it might be possible to use less precious plating metals having a lower conductivity, thereby further reducing the cost of the conductor.

It is also evident from U.S. Pat. No. 4,210,376 that the conductors thereof comprise stamped strips which include integrally formed barbs along the length thereof which act to retain each conductor within channels or slots formed in the housing. The use of such stamped conductors, while not unacceptable, requires special forming and cutting machinery, and can result in more material waste when compared to the use of standard round conductor wires. It would therefore appear that if means could be provided in the connector housing for retaining standard conductor wires, it would be an improvement over the barbed flat conductor strips evident from this patent.

During use of such a connector, it may be necessary to short together two of the conductors in the connector when the mating plug is removed. This occurs, for example, when the printed circuit requires a circuit path to be closed in certain applications in the absence of the mating plug. It would therefore be desirable to be able to provide an improved connector wherein means are provided for automatically shorting two or more conductors when the mating plug is not inserted into the connector.

Certain applications where printed circuit boards are utilized require a closely-spaced array of parallel PCBs. If one or more boards require a modular connector of the type discussed above, it is important that the height of the connector be made as small as possible, in order that the overall circuit board array will take up as little space as practicable. Presently available connectors, however, have not been designed with much thought to such a requirement. It would therefore be very desirable if a low profile connector of the type described could be provided which permits use of the connector with very closely spaced printed circuit boards in a space-economical fashion.

It is towards achieving these advantages and overcoming the noted deficiencies of the state of the art connectors that the present invention is advanced.

OBJECTS OF THE INVENTION

It is therefore a primary object of the present invention to provide a new and improved electrical connector which overcomes the disadvantages noted above with respect to presently available connectors.

Another object of the present invention is to provide an electrical connector for interfacing a printed circuit board with a modular plug which utilizes a plurality of conductors in the connector housing which have a length that is much less than the length required for previously available connectors.

A further object of the present invention is to provide an electrical connector for interfacing a modular plug with a printed circuit board which permits use of short gold-plated wires and which provides retaining means integral with the connector housing to obviate the requirement for barbs on the conductors.

A still further object of the present invention is to provide an electrical connector for mating with a modular plug wherein the spring contact portions of the connector conductors are of greatly reduced length so that a very short movement of the plug achieves the desired mating contact pressure between the spring contact portions and the plug terminals, and wherein the spring contact pressure may be adjusted to permit use of less expensive metal platings.

Another object of the present invention is to provide an electrical connector adapted to mate with a modular telephone plug wherein means are provided for automatically shorting two or more of the spring contact portions of the conductors in the connector housing when the mating plug is removed from the connector.

Still another object of the present invention is to provide an electrical connector having spring contact wires which are electromagnetically screened by the mating plug from the conductors that are terminated within the plug.

A still further object of the present invention is to provide an electrical connector which includes new and improved snap lock mounting posts for securing the connector housing to an apertured panel, such as a printed circuit board.

An additional object of the present invention is to provide a low profile electrical connector for mating a miniature modular plug with a printed circuit board which is particularly designed for use with a plurality of closely spaced printed circuit boards.

An additional object of the present invention is to provide a very low profile connector adapted to interface a modular mating plug with a printed circuit board which includes means for releasably retaining a side-mounted latching arm assembly on the mating plug on the side wall of the connector housing.

Another object of the present invention is to provide a low profile modular plug having a side-mounted latching bar assembly adapted to mate with a special low profile jack.

SUMMARY OF THE INVENTION

The foregoing and other objects are attained in accordance with one aspect of the present invention through the provision of an electrical connector which comprises a housing having a front portion, a rear portion and an outer wall, and an opening formed in the front portion of the housing which is adapted to receive a mating plug which has a plurality of side-by-side contacts. The opening is defined by a rear partition, an inner end wall and inner side walls, the rear partition including a plurality of side-by-side apertures formed therein, the inner end wall including a plurality of side-by-side slots formed therein. The connector further includes a plurality of electrical conductors arranged in a side-by-side spaced apart fashion in the housing, each of the conductors including a first end portion extending normally from the outer wall, a first intermediate portion extending through one of the apertures in the rear partition, a second intermediate portion formed between the first end portion and the first intermediate portion, and a second end portion extending from the first intermediate portion in one of the apertures forwardly towards the opening and diagonally into one of the slots in the end wall. Second end portions of the plurality of conductors form spring contacts which are adapted to mate with the side-by-side contacts in the mating plug.

Each of the conductors may be thought of as being included in a plane defined by its first end portion and the point of spring contact of its second end portion with the terminals in the mating plug. The planes so defined by the plurality of conductors are non-parallel, resulting in the desired differential spacing between those portions of the conductors which mate with the mating plug and the other end portions which mate with the printed circuit board pads.

Means are provided for retaining the conductors in the apertures formed in the rear partition. Such retaining means more particularly comprises a recess formed in the housing adjacent the apertures in the rear partition which defines a locking strip that is heat-sealed to close the apertures about the first intermediate portions of the conductors.

In accordance with another aspect of the present invention, the outer wall includes post means extending therefrom and adapted to fasten the housing adjacent the printed circuit board. The post means more particularly comprises at least one locking post adapted to extend through a hole formed in the printed circuit board, the locking post including a pair of symmetrically formed spaced post members having a slot positioned longitudinally therebetween to permit the post members to flex towards one another upon insertion into the hole.

The side-by-side slots formed in the inner end wall of the connector opening may extend through the end wall to the outer wall of the connector, or may be closed off by the outer wall of the housing to prevent solder from the wave-soldering operation from shorting the spring contact portions together.

In accordance with another aspect of the present invention, the second end portions of the conductors extend into respective ones of the side-by-side slots to a position below the plane of the inner end wall, the second end portions being free to move within their respective slots. Means may also be provided which are selectively attachable to the housing for shorting at least two of the second end portions of the conductors together only when the contacts of the mating plug are not in spring contact with the two second end portions. Means are preferably formed on the housing for mounting the shorting means, the latter preferably comprising a metallic shorting bar having at least two fingers integrally extending from the bar and adapted to contact the two second end portions of the conductors. The fingers of the shorting bar, when positioned on the mounting means, extend into the slots of the inner bottom wall to positions just above those of the two second end portions so that, prior to full insertion of the plug into the opening, the two fingers contact the two second end portions, respectively. Upon full insertion of the mating plug into the opening, the two second end portions are pushed by spring contact with the side-by-side contacts in the plug out of engagement with the shorting bar fingers. The mounting means preferably comprises post means extending integrally from an outer side wall of the housing adjacent the slots in the inner bottom wall, the shorting bar including aperture means adapted to be press-fit onto the post means.

The conductors are preferably plated, on all or a portion thereof with a precious metal, such as gold. Alternately, the conductors may be tin plated over either their entirety or a portion thereof. In one embodiment, the conductors may be tin plated on the first end portion thereof and may be gold plated on the second end portion thereof.

In accordance with another aspect of the present invention, the housing further includes a pair of spaced side walls which extend vertically from opposite sides of the inner bottom wall, the top surfaces of the spaced side walls forming the top wall of the housing which is open above the inner bottom wall to thereby form a low profile housing. The height of the spaced side walls is such that a portion of the mating plug when inserted in the opening extends above the top wall. The housing may further include a pair of mounting flanges each having an upper surface and a lower surface, the flanges extending laterally outwardly from the spaced side walls and including post means formed on the lower surfaces for mounting the housing to the printed circuit board. The housing includes a base portion, the upper surface thereof comprising the inner bottom wall of the opening which is formed in a plane that is spaced below the plane formed by the upper surfaces of the mounting flanges to thereby further reduce the overall height of the connector housing. A ledge may extend rearwardly from the rear partition and includes a bottom surface which comprises the outer wall of the housing, the bottom surface being substantially coplanar with the lower surfaces of the mounting flanges. The base portion of the housing in this low profile embodiment may be adapted to fit within a cut-out formed in the printed circuit board.

In accordance with yet another aspect of the present invention, one of the inner side walls of the lower profile connector housing may include means formed integrally therewith for retaining the mating plug in the housing. The retaining means comprises means for releasably latching a locking arm assembly which is positioned on the side wall of the mating plug. The releasable latching means, in one form, comprises an inclined surface which extends inwardly from the front portion of the housing and from the inner side wall, and a notched rear face extending from the tip of the inclined surface to the inner side wall. The position of the inclined surface along the front portion of the housing is provided so as to permit a latch releasing arm formed as part of the locking arm assembly to pass freely through the opening.

The connector of the present invention may be provided further in combination with a mating plug having a locking arm assembly positioned on a side wall thereof. The locking arm assembly may comprise a pivotable latching piece extending rearwardly from the front portion of the side of the plug and terminating in a latching piece adapted to mate with the notched rear face of the latching means of the housing, and a latch releasing arm positioned adjacent and connected to the latching piece and adapted to extend rearwardly out of the opening when the mating plug is inserted therein to permit the latching piece to be released from the notched rear face.

BRIEF DESCRIPTION OF THE DRAWINGS

The foregoing and other objects, aspects and features of the present invention will be more fully appreciated as the same becomes better understood from the following detailed description of the present invention when viewed together with the accompanying drawings in which:

FIG. 1 is a side sectional view of a first preferred embodiment of the electrical connector of the present invention;

FIG. 2 is a bottom view of the preferred embodiment illustration in FIG. 1;

FIG. 3 is a rear view of the preferred embodiment illustrated in FIG. 1;

FIG. 4 is a front view of the electrical connector illustrated in FIG. 1;

FIG. 5 is a perspective view, partially cut-away, of the preferred embodiment of the electrical connector illustrated in FIG. 1;

FIG. 6 is a view similar to FIG. 1 but showing the connector mated with a miniature modular plug;

FIG. 6*a* is a plan view of the shorting bar assembly shown mounted in FIG. 6;

FIG. 6*b* is a side view illustrating one possible angle for the spring contact portions of the conductors;

FIG. 6*c* is a side view illustrating another possible spring contact angle;

FIG. 7 is a perspective view similar to FIG. 5 but showing an embodiment of a low profile connector in accordance with the present invention;

FIG. 8 is a side sectional view of the alternate embodiment of FIG. 7;

FIG. 8*a* is a rear view of the embodiment of FIG. 8;

FIG. 8*b* is a rear view showing an alternative embodiment to that of FIG. 8*a;*

FIG. 8*c* is a sectional view of the alternate embodiment of FIG. 8*b* taken along lines 8*c*—8*c* thereof;

FIG. 9 is a view similar to FIG. 8, but showing the connector with its mating plug in place;

FIG. 9*a* shows an equipment housing adapted to receive the assembly of FIG. 9;

FIG. 10 is a perspective front view of a further alternate embodiment of the present invention;

FIG. 11 is a perspective front view of yet another alternate embodiment of the present invention;

FIG. 12 is a perspective view of a printed circuit board with which the embodiments of FIGS. 10 or 11 may be utilized;

FIG. 13 is a perspective view of a novel mating plug which is designed to be utilized with the embodiment of FIG. 11;

FIG. 14 illustrates an array of PCBs utilizing the embodiment of FIG. 11;

FIG. 15 is a side sectional view of an alternate embodiment to that shown in FIG. 1; and FIG. 16 is a rear view of the alternate embodiment shown in FIG. 15.

DETAILED DESCRIPTION OF THE PREFERRED EMBODIMENTS

Referring now to the drawings, wherein like reference numerals represent identical or corresponding parts throughut the several views, and more particularly to FIGS. 1–5 thereof, one embodiment of the electrical connector of the present invention is indicated generally by reference numeral 10.

Connector 109 includes a one-piece molded plastic housing 12 having a front outer wall 14, a rear outer wall 16, a top outer wall 18, a bottom outer wall 20 and outer side walls 22 and 24. It should be understood that the designation of wall 18 as a "top" wall is made with respect to the view of the housing 12 illustrated in FIG. 1, but that, in use, wall 18 may in fact be oriented as a bottom wall. The designations "top" and "bottom" are therefore made for ease in explanation of the invention, and should not be interpreted as limiting in any way.

An opening 26 is formed in the front outer wall 14. Opening 26 is adapted to receive a miniature modulator mating plug (indicated generally by reference numeral 30 in FIG. 6) which may be, for example, of the general type described in U.S. Pat. No. 3,954,320 to Hardesty. As described therein, the telephone-type modular plug generally includes a dielectric housing having a free end for insertion into a mating modular jack, a cord input end having a cavity for receiving a multi-conductor cord, and a resilient locking tab integrally connected by a flexible hinge to the free end of the dielectric housing and extending obliquely rearwardly therefrom. The modular plug housing is also characterized by a terminal-receiving side having partitions which define side-by-side slots in communication with the cavity. Substantially flat, electrically conductive contact terminals are positioned within the slots and extend into the cavity, and the terminals include insulation-piercing tangs for making electrical engagement with associated conductors of the cord and upper edge portions for making electrical contact external to the plug.

Referring back to FIGS. 1–5, opening 26 is defined by opposed internal end walls which include inner bottom wall 28 and inner top wall 32, and opposed inner side walls 34 and 36.

Top wall 32 includes a forwardly disposed inclined ramp 38 which extends to spaced apart shoulders 40 which cooperate with shoulders formed on locking bar 50 (see FIG. 6) to maintain plug 30 in place within opening 26. A substantially rectangular, elongated recess or keyway 42 may extend from front wall 14 rearwardly in side wall 34 for receiving a mating key formed on the side of certain mating plugs.

Opening 36 is further defined by an inner rear wall 44 which forms an outer wall of a rear partition member 46 which extends transversely across the rear portion of the housing 12. Rear partition 46 further includes an upper wall 48, a bottom wall 52, a back wall 54 and an intermediate back wall 56. Intermediate back wall 56, in turn, forms the terminal portion of a plurality of slots 58 which extend from the back wall 54 to the intermediate back wall 56. Slots 58 are formed in alternating conductor positions, as will become more clear hereinafter.

A plurality of apertures or holes 60 extend from the back wall 54 of partition 46 to the inner rear wall 44 for receiving portions 62*d* of conductor wires 62. Coplanar with apertures 60 and formed in alternating positions longitudinally through rear partition 46 are apertures 64 which extend from the intermediate back wall 56 at the rear of slots 58 to the inner rear wall 44 of opening 26. Apertures 64, which are shorter than coplanar apertures 60, are adapted to receive portions 66*d* of conductor wires 66. Conductors 62 and 66 extend through housing 12 in a side-by-side, alternating spaced apart fashion, and may be round, rectangular, or stamped metallic parts. Conductors 62 and 66, however, are preferably round conductor wires which are coated with a precious metal, such as gold, to increase their conductivity, longevity and reliability. Conductors 62 and 66 may be coated or plated with other metals, such as tin, or a portion thereof may be coated with tin while another portion thereof may be coated with gold, as will be explained in greater detail below.

The ends of apertures 60 and 64 which terminate at inner rear wall 44 open onto conductor receiving means which preferably takes the form of a plurality of parallel side-by-side slots 72 formed in bottom wall 28. Slots 72 preferably extend from wall 44 downwardly and forwardly along bottom wall 28 and are deep enough to accommodate the spring contact portions **62*c* and 66*c* of conductors 62 and 66 as they move under spring contact pressure applied by terminals 106 in mating plug 30 (see FIG. 6**).

Top outer wall 18 includes at the rear portion thereof a plurality of inwardly extending slots 74 and 76 which are adapted to receive and retain the end portions **62*b* and 66*b* of conductors 62 and 66, respectively, that extend upwardly from the back walls 54 and 56 of partition 46. End portions 62*b* and 66*b* of conductors 62 and 66 extend perpendicularly from outer wall 18 in an alternating, staggered fashion so as to be readily insertable within correspondingly spaced holes in a printed circuit board. The spacing between adjacent end portions 62*b* and 66*b* measured laterally may be, for example 0.050 inch to correspond with standard pad spacing on the printed circuit board. This means that adjacent alternating slots 74 and 76 are formed with the same center-to-center spacing as would be required for end portions 62*b* and 66*b*** of the conductors.

The inner ends of slots 74 and 76 are preferably sized slightly smaller than the diameter of conductors 62 and 66. After being forced into slots 74 and 76, conductor end portions **62*b* and 66*b* will then be held in place by the cold flow of plastic around the wires at the ends of the slots. A heat-sealing tool may subsequently be applied transversely across the open ends of slots 74 and 76 to further secure the position of the end portions 62*b* and 66*b*** of the conductors.

As is apparent from FIG. 1, back wall 54 of partition 46 is in substantial alignment with the inner ends of slots 74, while intermediate rear wall 56 is in substantial alignment with the inner ends of slots 76. The conductor portions **62*a*, therefore, which extend upwardly from their respective apertures 60 formed in partition 46, all lie in substantially the same plane, which plane is spaced rearwardly from and parallel to the plane formed by conductor portions 66*a* which extend vertically from apertures 64**.

Referring to FIG. 3, it may be appreciated that the portions **62*a* and 66*a* of conductors 62 and 66 which extend across the rear portion of the housing 12 are flared from their spacing as they emerge from apertures 60 and 64 to the point where they enter slots 74 and 76, respectively. This flaring provides the required differential spacing between end portions 62*b*, 66*b* and spring contact portions 62*c*, 66*c* which extend forwardly and downwardly from their respective apertures 60 and 64, as viewed in FIG. 4**.

It also may be appreciated that each of the conductors 62 and 66 includes an intermediate portion **62*d* and 66*d* which extend through the respective apertures 60 and 64. The intermediate portions 62*d* and 66*d* of conductors 62 and 66 all lie in a single plane, which plane is substantially perpendicular to the planes formed by the vertical portion 62*a* and 66*a* of conductors 62 and 66**.

As may be seen in FIGS. 1 and 2, a channel 68 is formed in bottom wall 52 and extends transversely under the side-by-side apertures 60 and 64 to define a relatively thin locking strip 70. Locking strip 70 is illustrated in FIG. 1 prior to its being heat-sealed about the portions **62*d* and 66*d* of the conductors that extend through the apertures 60 and 64. FIG. 6 illustrates channel 68 and strip 70 after a heating tool, such as an ultrasonic device, is applied to cause the plastic strip 70 to melt somewhat and thereby flow around the intermediate portions 62*d* and 66*d* of the conductors which extend through the apertures 60 and 64 formed immediately above strip 70. This heat-sealing technique serves to retain conductors 62 and 66 longitudinally within housing 12**.

The mating pressure of the spring contact portions **62*c* and 66*c* of the conductors within opening 26 may be controlled by the angle at which the spring portions are bent along edge 71. For example, a high-pressure contact system may be obtained by use of a shallow angle of the spring portions of the conductors, as seen in FIG. 6*b*, while a low-contact mating pressure, such as is suitable for precious metal plated contacts, may be obtained by a relatively steep angle imparted to the spring portions of the conductor as illustrated in FIG. 6*c***.

FIG. **6*b* illustrates a relatively shallow angle for spring contact portion 66*c* which will yield greater mating pressure with terminal 106 of plug 30 when compared with the configuration of FIG. 6*c*. The embodiment of FIG. 6*b* may provide sufficiently high mating pressures to permit portions 66*c*** to be plated with a much less expensive metal, such as tin, which will further reduce the cost of the connector.

FIG. **6*c* illustrates a typical configuration wherein the spring contact portion 66*c* is gold plated for higher conductivity. The shallow angle portion 66*c* does not require as large a pressure (compared with FIG. 6*b*) from contact terminal 106 of mating plug 30 (FIG. 6) to establish a satisfactory connection and, in addition, minimizes the distance of portion 66*c* over which the edge 110 of terminal 106 moves during insertion and withdrawal of plug 30, thereby further reducing wear and tear on the mating portions. Further, portion 66*c* of FIG. 6*c* does not bend as much about fulcrum 71 during insertion and withdrawal of plug 30**, further adding to the longevity and reliability of the connector.

Since only spring portions **62*c* and 66*c* may be gold plated, or the entire length of conductors 62 and 66 may be gold plated, the above-noted reductions in the length both of the spring portions themselves as well as the overall conductors can result in a significant cost savings. Alternatively, however, it is possible to gold plate the spring contact portions 62*c* and 66*c*, while the other end portions 62*b* and 66*b* may be, for example, tin plated. For a high-pressure contact system (FIG. 6*b*), the entire conductors 62 and 66 may be tin plated. In both cases, the spring contact portions have a relatively short length, and the proximity of fulcrum point 71 to contact point 110** allows a rapid transition to the desired mating pressure by very short movement of the mating plug.

An alternate embodiment of the connector of FIGS. 1–5 is illustrated in FIGS. 15 and 16 to which attention is now directed. FIGS. 15 and 16 respectively illustrate a side sectional and rear view of the alternate embodiment which differs from the first embodiment in that the spring contact portions of the conductors extend forwardly and upwardly into the top wall of the connector housing, rather than forwardly and downwardly into the bottom wall as with the first embodiment. The embodiment of FIGS. 15 and 16 further decreases the length of the conductors, and results in a connector configuration which will accept a mating plug in the reverse orientation from that illustrated in FIG. 6. Thus, in the embodiment of FIGS. 15 and 16, the locking arm 50 of mating plug 30 is rendered more accessible, therefore the mating plug may be more easily removed from the connector housing than with the first embodiment, if desired.

The connector of FIGS. 15 and 16 includes a front outer wall 14, a rear outer wall 16, a top outer wall 18 and a bottom outer wall 20. Formed in the front outer wall 14 is a plug-receiving opening 26 which is defined by a opposed internal end walls which include inner bottom wall 27 and inner top wall 29. Opening 26 is further defined by opposed inner side walls 31 and 33 (not shown). Formed in the forward portion of bottom wall 27 is a ramp 35 having shoulders 37 for receiving and locking the latching arm assembly of the mating plug (not shown). A keyway 39 may be disposed in inner side wall 31 for receiving a similarly formed key in the side of the mating plug.

The opening 26 is further defined by an inner rear wall 41 which forms an outer wall of a partition 43 which extends transversely between the side walls of the housing. The partition 43 include an upper wall 45 (which may be contiguous with top outer wall 18), a bottom wall 47, a back wall 49 and an intermediate back wall 51. Intermediate back wall 51 is defined in turn by a plurality of slots 53 which extend from the back wall 16 and which are formed in alternating conductor positions.

A plurality of apertures 55 extend from the back wall 49 to the inner rear wall 41 for receiving portions **57*d* of conductors 57, while a plurality of shorter apertures 59 extend from the intermediate back wall 51 to the inner rear wall 41 for receiving intermediate portions 61*d* of conductors 61**.

A channel 63 is formed in bottom wall 47 to define a locking strip 65 that extends transversely below apertures 55 and 59. As with the first embodiment, a heating tool may be applied to locking strip 65 to cause same to flow about and thereby lock the intermediate portions **57*d* and 61*d* of conductors 57 and 61**.

The forward end of apertures 55 and 59 open onto conductor-receiving means which preferably takes the form of a plurality of side-by-side slots 67 that extend from wall 41 upwardly and forwardly across top wall 29. Slots 67 are adapted to receive the tips of the spring contact portions **57*c* and 61*c* of conductors 57 and 61 which extend forwardly and diagonally thereinto. Reference numeral 69 indicates the bending or fulcrum point for spring contact portions 57*c* and 61*c***.

The formation of the conductor-receiving slots 74 and 76 in the rear wall 16 of the connector may be substantially the same as that illustrated in FIG. 3. It will be appreciated that each of the conductors 57 and 61 include other intermediate portions **57*a*, 61*a* which extend across a portion of the rear of the housing in a non-parallel manner to create the desired lateral differential spacing between the printed circuit board matable end portions 57*b*, 61*b* and the spring contact portions 57*c* and 61*c*. Stated another way, the connector housing is provided with means whereby the end portions 57*b* and 61*b* extend perpendicularly from the outer wall 18 of the housing in two substantially parallel rows. One row includes all of the end portions 57*b* while the other row includes all of the end portions 61*b*. The differential spacing provided by flared intermediate portions 57*a*, 61*a* result in the fact that the distance between the end portions of any two conductors in one row, for example, the distance between any two end portions 61*b*, will be greater than the distance between the corresponding spring contact portions 61*c*** of the same two conductors. This is simply another way of stating the desired end result of differential spacing.

Referring now to FIGS. 7 and 8, there is illustrated an alternate embodiment of the present invention which is indicated generally by reference numeral 126 and which comprises a low profile connector particularly suitable for use on a printed circuit board where space is at a premium. This occurs, for example, where the physical arrangement of the printed circuit board next to other equipment components or housings is such as to severely limit the space in which a connector may be placed. The form of the invention illustrated in FIGS. 7 and 8 omits the use of an integral, enclosed top wall of the housing, and consequently requires that another equipment component provide means for latching the locking bar assembly 50 of the plug 30. For example, in FIG. **9*a*, equipment housing 125 is shown having a PCB 127 positioned therein. The inside wall 129 of housing 125 includes shoulders 131 and a ramp 133 for releasably receiving the locking bar assembly 50 of plug 30**.

Referring to FIGS. 7 through 9, low profile housing 126 includes outer side walls 128 and 130 which extend vertically from the side portions of inner bottom wall 142 so as to form an open top portion or area. An outer rear wall 132 connects the side walls 128 and 130, and a pair of mounting posts 136 extend downwardly from the outer bottom wall 134. An opening 138 is formed in the front portion of the housing 126 and is defined by inner side wall 140, inner bottom wall 142 and transversely extending rear partition 144. A keyway 146 may also be provided in side wall 140. The top wall 148 of this embodiment is substantially U-shaped and is defined by the top surfaces of side walls 128, 130 and rear wall 132.

As with the first embodiment, partition 144 is provided with a plurality of apertures 150 which extend from front face 154 to rear face 156, and a plurality of apertures 152 located in alternating positions to apertures 150 and which also extend from front face 154 to intermediate rear face 158. Recessed faces 158 are defined by a plurality of slots 160 formed in the rear wall 133. In the lower outer wall 134 are formed alternating depth slots 162 and 164, similar to slots 74 and 76 of the embodiment of FIG. 5.

The inner bottom wall 142 is also provided with a plurality of longitudinal slots 166 which extend downwardly through to the bottom wall 134 of the housing. Reference numerals **168*a* and 170*a* refer to the flared portions of the conductors (see FIG. 8*a*) which extend from the rearmost portions of apertures 150 and 152 downwardly to slots 162 and 164. Extending integrally from flared portions 168*a* and 170*a* are portions 168*b* and 170*b* which extend normally from the lower face 134 of the housing in an alternating, staggered fashion. Reference numerals 168*d* and 170*d* indicate the intermediate portions of the side-by-side conductors which extend in a plane which is substantially parallel to inner bottom wall 142 but is spaced upwardly therefrom. Extending from intermediate portions 168*d* and 170*d* are spring contact portions 168*c* and 170*c* which extend downwardly and forwardly from the respective apertures formed in rear partition 144. As in the first embodiment, the ends of spring contact portions 168*c* and 170*c* extend into slots 166 so as to reside below the plane formed by bottom wall 142 and are adapted to move freely within slots 166 upon insertion of plug 30**.

A channel or recess 172 is formed adjacent to and rearwardly of slots 166 and defines a heat-meltable locking strip 174 for securing the intermediate portions 168*d* and 170*d* of the conductors, as illustrated in FIG. 9. Edge 175 of apertures 150 and 152 indicate the point of bending of the conductors 168 and 170 and the fulcrum for the spring contact portions 168*c* and 170*c*. FIG. 9 illustrates the connector of FIG. 8 with the plug 30 inserted fully therein, reference numeral 176 indicating the point of spring contact between terminal 106 of plug 30 and portion 170*c* of conductor 170.

In this embodiment, as well as in the earlier embodiments, it is not absolutely necessary that the transition portion of the conductors (i.e., the portions 168*a* and 170*a* of the conductors which are non-parallel) extend across the rear face of the housing as illustrated in FIGS. 3, 16 and 8*a*. Alternately, the transition of the conductors, which results in the desired differential spacing can occur in the partition member itself. For example, as illustrated in FIGS. 8*b* and 8*c*, instead of having parallel apertures 150 and 152 (FIGS. 8 and 8*a*), partition 144 may include specially formed angled holes or apertures 151 and 153 for respectively receiving the non-parallel transition portions 168*e* and 170*e* of conductors 168 and 170. Apertures 151 and 153 are specially formed in a somewhat conical manner so as to permit the plastic molding of the connector in one piece. The transition portions 168*e* and 170*e* therefore lie in the plane of apertures 151 and 153, which is perpendicular to the planes in which the transition portions of the previous embodiments were formed. This construction results in portions 168*f* and 170*f* which extend over the rear end of the connector which are all substantially parallel to one another. Due to the presence of transition portions 168*e* and 170*e*, the construction still results in end portions 168*b* and 170*b* which are laterally offset from each other a distance which is greater than their corresponding spring contact portions 168*c*, 170*c*, as may be appreciated from comparing FIGS. 8*b* and 8*c*.

Referring now to FIG. 10, there is illustrated still another alternate embodiment of the present invention which is indicated generally by reference numeral 180 and comprises an extremely low profile connector designed in particular for use on PCBs arranged in a closely spaced parallel array where space is at a premium. Connector 180 includes a housing 182 defined by a base 184 which is adapted to fit within a cut-out portion 216 of a printed circuit board 210 (see FIG. 12). Housing 182 further includes parallel, spaced side walls 183 and 185 between which extends inner bottom wall 186. Base 184 includes outer bottom wall 188 which is preferably closed so as to close off slots 206 formed in inner bottom wall 186. The closure of the slots 206 prevents wicking of the wave solder up onto the flexible portions of the spring contact wires 200 during wave soldering of the other end portions thereof.

Housing 182 further includes a pair of side support flanges 190 which extend laterally from side walls 183 and 185. Flanges 190 include an upper surface 192 and a lower surface 194. Extending from lower surfaces 194 are a pair of mounting posts 196 which mount through openings 218 formed in board 210 (FIG. 12). Preferably, the inner bottom wall 186 of the base portion 184 of the housing is positioned in a plane which is lower than upper surface 192 of flanges 190, and preferably lower than the plane in which the lower surfaces 194 of flanges 190 are formed. This results in a positioning of the mating plug wherein the lower surface thereof is at a height close to or lower than the top side 210 of the printed circuit board. The rear ledge 198 of connector 180 retains the solder tips of the other ends of the conductors in the desired alternating, staggered alignment, and can be formed in a manner similar to that illustrated for example in FIG. 8.

The spring contact portions 200 of the plurality of conductors extend through apertures 204 formed in the rear partition 202. The top wall 208 of the connector is substantially U-shaped and extends along the top surfaces of side walls 183 and 185 as well as the rear wall 187. Top wall 208 is open above the inner bottom wall 186 of the connector.

FIG. 12 illustrates an edge of a printed circuit board 210 having apertures 212 formed in an alternating, staggered fashion so as to receive the wave-solderable end portions of the conductors of the housing 180 therethrough. Apertures 218 are also illustrated for receiving the mounting posts 196, and cutout 216 is provided for receiving base portion 184. Reference numeral 214 indicates the underside of board 210 which includes the printed circuit portions thereof. Surface 188 of base 184 may be close to or below side 214 of board 210 to achieve the minimum height obtainable for connector housing 180.

FIG. 11 illustrates a modified embodiment of the low profile connector of FIG. 10 wherein the base 184 is widened and one of the inner side walls 183 is modified to include a latching means indicated generally by reference numeral 220 located at the upper portion of inner side wall 183. Latching means 220 includes a curved or tapered surface 222 which extends rearwardly from front wall 224 and outwardly from side wall 183. Inclined surface 222 terminates in a notched rear face 226 which is spaced forwardly from rear partition 202.

The design of FIG. 11 is adapted to mate with a modified modular plug such as plug 230 illustrated in FIG. 13. Plug 230 includes a multi-conductor cable 232 which is terminated inside housing 230 in a manner similar to the technique illustrated in FIG. 9. A side wall 234 of housing 230 includes a latching arm assembly indicated generally by reference numeral 236. Latching arm assembly 236 includes a release arm 238 which is pivotally mounted at the forward portion of housing 230 and which includes a spring section 242 having a flat face 240 adapted to mate with notched rear face 226 upon full insertion of housing 230 into the jack of FIG. 11. In this manner, the need for providing an auxiliary latching means externally of the low profile connector is obviated, and both the connector height and the plug height are substantially reduced. Note that the portion of side wall 183 immediately below inclined surface 222 permits insertion of the release arm 238 which extends out beyond front wall 224 to permit manual removal of the plug 230 when desired. Portion 242 of assembly 236 is connected to and adapted to pivotally move with latch arm 238.

FIG. 14 schematically illustrates an array of closely spaced, parallel PCBs 244, 246, 248 and 250 which are typically separated by a distance of 0.250 inch. Boards 246 and 248 each have a low profile connector 220 mounted thereon. Since the thickness of a typical board is about 0.062 inch, it may be appreciated that the overall height of connectors 220 may range between 0.150" and 0.300". Presently available connectors, having a height of about 0.600 inch, would clearly be unsuitable for mounting on the PCB array of FIG. 14, or would require a much larger cabinet or housing for the final configuration. The end size would obviously increase as the number of jack-mounted PCBs increased.

Obviously, numerous modifications and variations of the present invention are possible in light of the above teachings. It is therefore to be understood that, within the scope of the appended claims, the invention may be practiced otherwise than as specifically described herein.

I claim as my invention:

1. A telephone-type modular jack for directly coupling to a printed circuit board a telephone-type modular plug, the modular jack comprising:

an insulating housing having a front portion, a rear portion and an outer wall for positioning adjacent the printed circuit board;

an opening formed in said front portion of said housing for receiving the modular plug, said opening defined by a rear partition, an inner end wall and inner side walls;

said outer wall, said rear partition and said inner end wall including means for accommodating a plurality of electrical conductors arranged in a side-by-side spaced apart fashion in said housing;

each of said conductors having one end portion extending normally from said outer wall and another end portion extending from said rear partition into said opening and towards said inner end wall;

said another end portions of said conductors engaging by spring contact the correspondingly spaced contact terminals in the modular plug upon insertion of the plug into the jack;

each of said conductors included in a plane defined by its said one end portion and the point of spring contact of its said another end portion, the planes so defined by said plurality of conductors being non-parallel.

2. A telephone-type modular jack for directly coupling to a printed circuit board a telephone-type modular plug, said plug including a locking tab and contact terminals, the modular jack comprising:

(a) an insulating housing having a front end, a rear end, and a plurality of external walls;

(b) plug-receiving opening means for receiving the modular plug extending into said front end of said insulating housing and having a plurality of internal walls;

(c) solder post means extending from said rear end of said insulating housing for insertion through alternating, staggered holes formed in the printed circuit board;

(d) a partition wall extending adjacent the rear portion of said plug-receiving opening means and having conductor-receiving means;

(e) a plurality of electrical conductors in side-by-side spaced-apart relationship, each of said conductors comprising:

(i) an intermediate portion in said conductor-receiving means of said partition wall;

(ii) a spring contact portion extending from said intermediate portion into said plug-receiving opening means from said rear portion of said plug-receiving opening means towards said front end of said insulating housing; and (iii) an end portion extending perpendicularly beyond one of said external walls to form said solder post means;

(f) said spring contact portions of said conductors engaging the contact terminals of the modular plug upon insertion of the plug into said plug-receiving opening means; and (g) said plug-receiving opening means further having recess means formed therein for receiving and releasably retaining the locking tab of the modular plug.

3. A modular jack as set forth in claim 2, further comprising conductor differential spacing means in said insulating housing for causing said end portions of said conductors to extend from said one external wall in two substantially parallel rows, the end portions of any two conductors in one row being laterally spaced from each other a distance greater than the corresponding spring contact portions of the same two conductors.

4. The modular jack of claim 2, wherein each of said conductors is included in a plane defined by said end portion and the point of spring contact of said spring contact portion, the planes so defined by said plurality of conductors being non-parallel.

5. The modular jack of claim 2, wherein one of said external walls includes slotted means of two different alternating lengths opening onto said rear end of said housing for retaining said end portions of said conductors in an alternating, staggered alignment.

6. The modular jack of claim 2, wherein one of said internal walls includes a longitudinally formed substantially rectangular keyway extending from said front end towards said rear end and adapted to receive a mating key formed on the side of the modular plug.

7. The modular jack of claim 2, further in combination with the modular plug having said locking tap positioned on a side wall thereof, said tab comprising a pivotable latching piece extending rearwardly from the front portion of said side wall of said plug and terminating in a locking face adapted to mate with a notched rear face of said recess means formed in an internal side wall of said plug-receiving opening means, and a latch releasing arm positioned adjacent and connected to said latching piece and adapted to extend rearwardly out of said plug-receiving opening means when said modular plug is inserted therein to permit said latching piece to be released from said notched rear face.

8. The modular jack of claim 2, wherein one of said external walls includes post means extending therefrom and adapted to fasten said housing adjacent the printed circuit board.

9. The modular jack of claim 8, wherein said post means comprises at least one locking post adapted to extend through a mounting hole formed in the printed circuit board, said locking post including a pair of symmetrically formed spaced post members having a slot positioned longitudinally therebetween to permit said post members to flex towards one another upon insertion into the hole.

10. The modular jack of claim 9, wherein each of said post members includes a substantially semi-cylindrical constant diameter base portion extending from said external wall, and a substantially tapered head portion extending from said base portion, the diameter of said head portion at the free end of said post being less than that of said base portion, the diameter of said head portion where it meets said base portion being greater than that of said base portion to form a locking ledge.

11. The modular jack of claim 2, wherein one of said internal walls of said plug-receiving opening means includes a plurality of side-by-side slots each adapted to receive one of said spring contact portions of said conductors.

12. The modular jack of claim 11, wherein said side-by-side slots formed in said one internal wall extend from one internal wall through said housing to another of said external walls disposed on the opposite side of said housing from said one of said external walls.

13. The modular jack of claim 12 wherein said one internal wall comprises an inner bottom wall of said opening, said plug-receiving opening means being further defined by an inner top wall opposed to said inner bottom wall, said inner top wall including said recess means formed therein for retaining the locking tab of the modular plug.

14. The modular jack of claim 11, wherein said spring contact portions of said conductors extend into respective ones of said side-by-side slots to a position below the plane of said one internal wall, said spring contact portions being free to move within their respective slots.

15. The modular jack of claim 14, further comprising means selectively attachable to said housing for shorting at least two of said spring contact portions of said conductors together only when the contact terminals of the modular plug are not in spring contact with said at least two spring contact portions.

16. The modular jack of claim 15, further comprising means formed on said housing for mounting said shorting means.

17. The modular jack of claim 16, wherein said shorting means comprises a metallic shorting bar having means for contacting said at least two spring contact portions of said conductors.

18. The modular jack of claim 2, wherein said conductors have a precious metal plating.

19. The modular jack of claim 18, wherein said plating is formed over said spring contact portions of each of said conductors.

20. The modular jack of claim 2, wherein said conductors have a tin plating.

21. The modular jack of claim 20, wherein said tin plating is formed on said solder post means of said conductors.

22. The modular jack of claim 21, wherein said conductors further include a precious metal plating formed on said spring contact portions thereof.

23. The modular jack of claim 2, wherein said housing further comprises a pair of mounting flanges each having an upper surface and a lower surface, said flanges extending laterally outwardly from two of said external walls and including means formed on said lower surfaces for mounting said housing to the printed circuit board.

24. The modular jack of claim 23, wherein said housing further includes a rear ledge extending rearwardly from said rear end and including a bottom surface which comprises said one external wall of said housing, said bottom surface of said rear ledge being substantially coplanar with said lower surfaces of said mounting flanges.

25. The modular jack of claim 24, wherein said base portion of said housing is adapted to fit within a cut-out formed in the printed circuit board, said bottom surface of said rear ledge and said lower surfaces of said mounting flanges adapted to be positioned adjacent one side of the board next to said cut-out.

26. The modular jack of claim 23, wherein said mounting means comprises a pair of locking posts extending integrally from said lower surfaces of said mounting flanges, respectively, and adapted to extend through respective mounting holes formed in the printed circuit board.

27. The modular jack of claim 26, wherein each of said locking posts include a pair of symmetrically formed spaced post members having a slot positioned longitudinally therebetween to permit said post members to flex towards one another upon insertion into said hole.

28. The modular jack of claim 2, wherein said internal walls include a pair of opposed side walls which are substantially parallel to the contact terminals of the plug when the plug is inserted into said plug-receiving opening means, one of said side walls having said recess means formed therein.

29. The modular jack of claim 28, wherein the modular plug includes a pair of opposed outer side walls which are substantially parallel to the contact terminals of the plug, the locking tab of the plug extending rearwardly along one of said side walls.

30. The modular jack of claim 29, wherein said recess means comprises an inclined surface which extends inwardly from said front end of said housing and from said one side wall, and a notched rear face extending from the tip of said inclined surface to said one side wall.

31. The modular jack of claim 30, wherein the height of said inclined surface along said front end is less than the height of said one side wall to provide means adjacent thereto for receiving a latch releasing arm formed as part of the locking tab on the modular plug.

* * * * *